US007341112B2

(12) United States Patent
Doerr et al.

(10) Patent No.: US 7,341,112 B2
(45) Date of Patent: Mar. 11, 2008

(54) FIREFIGHTING TRAINING FLUID AND METHOD FOR MAKING SAME

(75) Inventors: Dennis G. Doerr, Fritch, TX (US); Nancy W. Eilerts, Kingwood, TX (US); Don E. Burnett, The Woodlands, TX (US); Daniel M. Coombs, Spring, TX (US); Eric J. Netemeyer, Borger, TX (US); Kirsten N. Caswell, Borger, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 0 days.

(21) Appl. No.: 11/390,756

(22) Filed: Mar. 28, 2006

(65) Prior Publication Data

US 2006/0177804 A1 Aug. 10, 2006

Related U.S. Application Data

(62) Division of application No. 10/305,748, filed on Nov. 27, 2002.

(51) Int. Cl.

| | |
|---|---|
| ***A62C 39/00*** | (2006.01) |
| ***A62C 3/00*** | (2006.01) |
| ***G09B 19/00*** | (2006.01) |
| ***C10L 1/24*** | (2006.01) |
| ***C10L 1/22*** | (2006.01) |

(52) U.S. Cl. ..... 169/46; 169/47; 169/44; 434/226; 44/385; 44/388; 44/447; 44/451; 44/628; 44/603

(58) Field of Classification Search ..... 169/46, 169/47

See application file for complete search history.

(56) References Cited

U.S. PATENT DOCUMENTS

| | | | | |
|---|---|---|---|---|
| 3,294,685 | A * | 12/1966 | Stevens et al. | 44/361 |
| 3,341,311 | A * | 9/1967 | Pedersen | 44/361 |
| 3,644,073 | A * | 2/1972 | Goldsmith | 431/2 |
| 4,389,220 | A * | 6/1983 | Kracklauer | 44/361 |
| 4,541,835 | A * | 9/1985 | Norton et al. | 44/326 |
| 4,908,045 | A * | 3/1990 | Farrar | 44/361 |
| 4,998,876 | A * | 3/1991 | Farrar | 431/3 |
| 5,055,050 | A * | 10/1991 | Rogers et al. | 434/226 |
| 5,411,397 | A * | 5/1995 | Rogers et al. | 434/226 |
| 5,713,964 | A * | 2/1998 | Schreiner et al. | 44/355 |
| 6,458,176 | B2 * | 10/2002 | Yeh et al. | 44/437 |
| 6,500,008 | B1 * | 12/2002 | Ebersole et al. | 434/226 |
| 6,858,048 | B1 * | 2/2005 | Jimeson et al. | 44/452 |

OTHER PUBLICATIONS

Hawley's Condensed Chemical Dictionary, 14th edition 2001, see p. 619 for definition of prefix "iso-".*

* cited by examiner

*Primary Examiner*—Joseph D. Anthony
(74) *Attorney, Agent, or Firm*—Conley Rose, P.C.; Rodney B. Carroll; Joe D. Hulett

(57) ABSTRACT

A firefighting training fluid (FFTF) comprising a paraffin blend. The blends of paraffins typically have no less than about two carbon atoms and no more than about twelve carbon atoms. The blends of paraffins may possess Reid vapor pressures in the range from about 2 to about 6.5 pounds per square inch. The blends also typically possess an initial boiling point of not less than about 80 degrees Fahrenheit and an end boiling point of not more than about 370 degrees Fahrenheit. The blends burn relatively cleanly and keep emissions of volatile organic compounds, compounds containing sulfur, smoke, particulates, olefins, and aromatics to a minimum. The blend components mixed to create the blends of paraffins are controlled in order to maintain Reid vapor pressure and initial and end boiling points. Oxygenates may be added to an FFTF in order to further reduce smoke emissions.

28 Claims, 8 Drawing Sheets

Gasoline/Diesel Paraffin Blend

Paraffin Blend with 14.5% Oxygenate

Paraffin Blend with 25% Oxygenate

Pan Residue After Burning Gasoline/Diesel Blend

Pan Residue After Burning Paraffin Blend

Paraffin Blend with 25% Oxygenate, Burn Residue

FIREFIGHTING TRAINING FLUID AND METHOD FOR MAKING SAME

CROSS-REFERENCE TO RELATED APPLICATIONS

This is a Divisional Application of U.S. patent application Ser. No. 10/305,748, filed Nov. 27, 2002 and entitled "Firefighting Training Fluid and Method for Making Same," which is hereby incorporated by reference herein in its entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This application relates generally to firefighting training fluids. More particularly, the application relates to a blend of paraffins that is an improved firefighting training fluid, and a method of making and using said blend. When burned, the firefighting training fluid provides reduced emissions of particulates and volatile organic compounds, while closely imitating the types of fires needed for firefighting training.

BACKGROUND OF THE INVENTION

Paraffins, also commonly known as alkanes, are one of the many components of petroleum. They are members of the homologous series of saturated hydrocarbons of the general molecular form $C_nH_{2n+2}$. Paraffins may be straight chains or branched (e.g., isoparaffins). Examples of the series of compounds of this form are methane ($CH_4$), ethane ($C_2H_6$), propane ($C_3H_8$), and butane ($C_4H_{10}$). Paraffins of various sizes (according to the number of carbon atoms, e.g., C2, C3, C4, and so on) are commonly separated from one another via distillation according to their various boiling points, where higher boiling points generally correspond to heavier paraffins. For example, under similar conditions, decane ($C_{10}H_{22}$) possesses a higher boiling point than pentane ($C_5H_{12}$). This relationship is also highlighted by the fact that, under similar conditions, paraffins include gases, liquids, and waxy solids. The gases are the lighter compounds, such as methane (C1) and propane (C3), the liquids are heavier than the gases (e.g., C8), and the waxy solids are yet heavier than the liquids. Similarly, the lighter paraffins generally possess lower flash points and boiling points, and higher vapor pressures, than the heavier compounds. As for their practical applications, paraffins are commonly used in charcoal starters, copier fluids, aviation and automotive fuels, lamp oils, solvents for insecticides and polishes, and camping fuels.

Firefighting training fluids ("FFTF") are combustible compounds used in training of firefighters. FFTFs are ignited in various situations to simulate accidental fires that would be encountered in both industrial and domestic environments. Common gasoline and/or diesel fuels, for example, may be used as FFTFs. However, burning such diesel fuels creates significant amounts of pollutants in the form of soot or smoke, and related particulates and volatile organic compounds. In addition, burning gasoline and/or diesel fuels leaves a residue that must be discarded as a hazardous waste, and any fuel that is not burned is often not reusable and also creates hazardous waste.

The various circumstances under which accidental fires occur often make it difficult to accurately replicate a particular type of fire for training purposes. This is true because of the wide range of combustibles that fuel accidental fires, and the wide range of structures in and around which the fires occur. For example, the fire fuel, props, and extinguishing techniques needed to duplicate and extinguish an accidental flange fire involving the leak of a light chemical at an industrial plant may be very different from the fire fuel, props, and extinguishing techniques needed to duplicate and extinguish a fire at a fuel storage warehouse. Typically, existing FFTFs are heavier compounds that possess higher boiling points and that, when burned, do not accurately simulate the types of fires associated with burning of lighter chemicals, such as the gases or solvents often involved in industrial fires. Thus, a need exists for improved, environmentally friendly FFTFs that accurately simulate a variety of fires.

SUMMARY OF THE INVENTION

In an embodiment, an FFTF comprising a blend of paraffins is disclosed. The overall FFTF composition as well as the individual blend components used to create the FFTF comprise paraffins in the range possessing from about two to about twelve carbon atoms. The FFTFs may have Reid vapor pressures in the range from about 2 to about 6.5 pounds per square inch. The FFTFs also may have an initial boiling point of not less than about 80 degrees Fahrenheit and an end boiling point of not more than about 370 degrees Fahrenheit. The FFTFs burn relatively cleanly and keep emissions of volatile organic compounds, compounds containing sulfur, smoke, particulates, olefins, and aromatics to a minimum. The blend components mixed to create the blends of paraffins may be controlled in order to maintain Reid vapor pressure and initial and end boiling points of the FFTF. Oxygenates may be added to FFTFs in order to further reduce smoke emissions.

In an embodiment, the blend components are blended in specific proportions in order to make an FFTF having desired burn characteristics, taking into account, for example, burn application and weather. Oxygenates may be added to the FFTF to make it more combustible. The FFTF may be dispensed and ignited in the desired firefighting training scenario. The blend may be heavier or lighter depending on the particular training application.

DETAILED DESCRIPTION OF EMBODIMENTS

Figure 1:
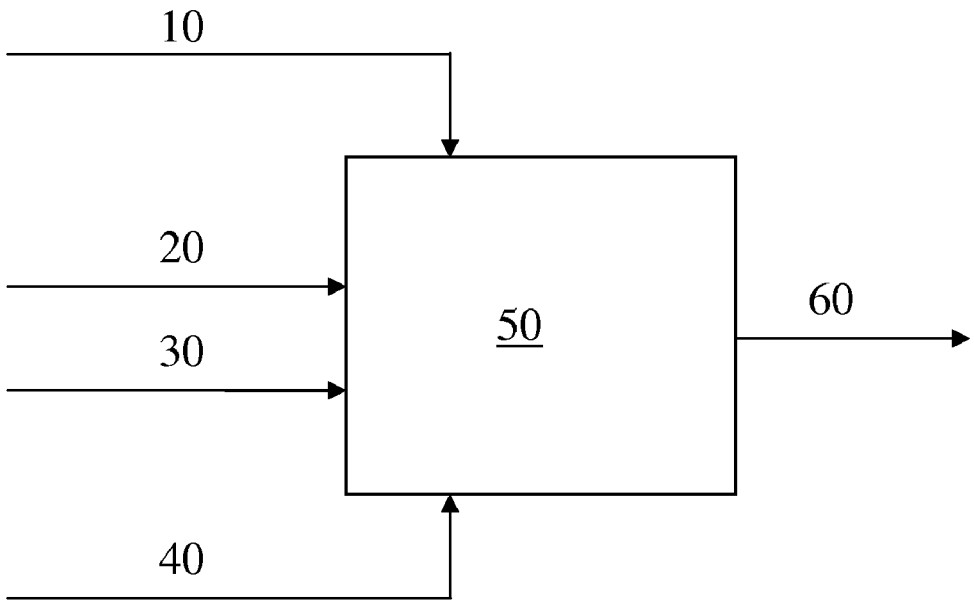
FIG. 1 is a block diagram illustrating an embodiment of a tank combining blend components to produce an FFTF.

An FFTF blend in accordance with the present invention comprises a mixture of one or more blend components, where each blend component may have the same or a different composition. The blend components contain the ingredients (e.g., paraffin compounds such as isopentane, hexane, heptane, octane, etc.) that ultimately make up the blend. The blend components comprise one or more paraffins having from two to twelve carbon atoms (C2 to C12). In an embodiment, an isopentane blend component comprises at least about 95 weight percent isopentane (C5). In another embodiment, a heavy paraffin blend component comprises at least about 55 weight percent decane (C10). In another embodiment, a light paraffin blend component comprises at least about 80 weight percent octane (C8). In yet another embodiment, an alkylate blend component comprises at least about 50 weight percent octane (C8).

The blend components comprising the FFTF blends of the present invention may have different sources. For example, in one embodiment a heavy paraffin blend component and a light paraffin blend component are different cuts from a petroleum refinery distillation column. In another embodiment, an alkylate blend component is from a hydrofluoric acid alkylation unit. In yet another embodiment, an isopentane blend component is from an isomerization unit. Any number and combination of blend components, each from a different source, may be mixed to create a desired FFTF. In an embodiment, a blend comprises two paraffin blend components, for example the heavy paraffin blend component and the light paraffin blend component. In another embodiment, a blend comprises three blend components, for example the heavy paraffin blend component, the light paraffin blend component, and an oxygenate, such as ethyl tertiary butyl ether, or ethanol. The various blend components that make up a particular blend are typically prepared by admixing the components simultaneously or in sequence in a container, such as a transportation or storage tank.

The FFTFs comprise, or alternatively consist essentially of, a blend of paraffins having no less than about 2 carbon atoms and no more than about 12 carbon atoms, alternatively having no less than about 4 carbon atoms and no more than about 12 carbon atoms, and alternatively having no less than about 5 carbon atoms and no more than about 11 carbon atoms. In an embodiment, an FFTF comprises at least about 1 weight percent isopentane, alternatively at least about 5 weight percent isopentane, alternatively at least about 10 weight percent isopentane, alternatively at least about 15 weight percent isopentane, and alternatively at least about 20 weight percent isopentane. In an embodiment, the FFTF is a blend of paraffins comprising, or alternatively consisting essentially of, less than about 0.1 weight percent C3; less than about 0.5 weight percent C4; from about 1.0 to about 20 weight percent C5; from about 0.5 to about 1.5 weight percent C6; from about 1.5 to about 6.5 weight percent C7; from about 19 to about 35 weight percent C8; from about 6 to about 11 weight percent C9; from about 28 to about 44 weight percent CIO; from about 9 to about 14 weight percent C11; less than about 0.1 weight percent C12; less than about 1.0 weight percent miscellaneous compounds, based on the total weight of the blend.

The Reid vapor pressure (RVP) is the vapor pressure measured according to ASTM D-323. Generally, the Reid vapor pressure of an FFTF blend herein may be adjusted up or down, depending on the time of year, geographic location, and particular firefighting training application for which a blend will be employed. The RVP may be adjusted up or down by manipulating the relative amounts of heavier and lighter paraffins in a blend. For example, pentane (C5) is lighter than, and possesses a higher RVP than, decane (C10). Thus, the RVP of a paraffin blend may generally be adjusted up or down by increasing the percentage of lighter or heavier paraffins, respectively, in the blend. The RVP may be adjusted depending on the desired burn characteristics that are to be mimicked. For example, a fire associated with the burning of a heavy fluid, such as a jet fuel, may possess different burn characteristics than a fire associated with a lighter fluid, such as a solvent fire in an industrial plant. Thus, the RVP may be adjusted up or down by manipulating the relative amounts of heavier and lighter paraffins, depending on the firefighting training application.

In an embodiment of FFTF blends, the relative amounts of blend components may be adjusted to achieve Reid vapor pressures from about 2 to about 6.5 pounds per square inch (psi), depending on the time of year, geographic location, and application. In an embodiment, the RVP is no less than about 2 psi, alternatively no less than about 2.5 psi, and alternatively no less than about 3 psi. In another embodiment where the season is winter, the RVP may be controlled in the range from about 5.5 to about 6.5 psi. In yet another embodiment where the season is summer, the RVP may be controlled in the range from about 2 to about 3 psi. In still another embodiment, the RVP may be controlled in the range from about 4 to about 5 psi. The time of year is considered because the RVP moves up or down with temperature. Thus, for the same training application, it is generally necessary to increase the RVP in winter and decrease the RVP in summer in order to achieve similar burn characteristics in both seasons based on the schedule of seasonal and geographical volatility classes presented in ASTM D-4814 with modified Vapor Pressure Classes specific to the paraffin blends described herein.

Boiling point is another characteristic to be considered with the paraffin blends of the present invention. Generally, lighter paraffins possess lower boiling points, and correspondingly lower ignition temperatures. As the percentage of heavier carbon compounds in a blend increases, so do the boiling point and ignition temperatures. As with RVP, the boiling points of the blends are controlled depending on the type of burn to be mimicked and season of the year. In an embodiment, the boiling range of the paraffin blend components is from about 80 degrees Fahrenheit to no more than about 370 degrees Fahrenheit. In another embodiment, the boiling range is from about 100 degrees Fahrenheit to about 370 degrees Fahrenheit.

In an embodiment involving cooler temperatures and/or duplication of a burn of lighter chemicals, the RVP may be adjusted to be in the range of from about 5.5 to about 6.5, while the same circumstantial considerations would cause the initial boiling point of a blend to be about 80 to 110 degrees Fahrenheit, alternatively about 100 to 110 degrees Fahrenheit. In contrast, in an embodiment involving warmer temperatures and/or duplication of a burn of heavier chemicals, the RVP may be adjusted to be in the range of from about 2 to about 3, while the initial boiling point of the blend would be from about 110 to 150 degrees Fahrenheit.

Generally, as long as the boiling point and RVP of the blend are controlled, the overall composition of the blend and/or the composition of the individual paraffin blend components may vary. For example, in an embodiment, an FFTF blend comprises a heavy paraffin blend component that is at least about 55 weight percent decane, and a light paraffin blend component comprising at least about 80 weight percent octane. The paraffin blend of this embodiment comprises no more than about 60 liquid volume percent of the heavy paraffin blend component, and no less than about 40 liquid volume percent of the light paraffin blend component. The resulting RVP is in the range of 2 to 3 psi and the initial boiling point is from about 110 to 150 degrees Fahrenheit.

In another embodiment, an FFTF includes a heavy paraffin blend component comprising at least about 55 weight percent decane, an isopentane blend component comprising at least about 95 weight percent isopentane, an alkylate blend component comprising at least about 50 weight percent octane, and a light paraffin blend component comprising at least about 80 weight percent octane. The paraffin blend of this embodiment comprises from at least about 50 to about 80 liquid volume percent of the heavy paraffin blend component, from 0 to about 10 liquid volume percent of the light paraffin blend component, from 1 to about 5 liquid volume percent of the isopentane blend component, and from at least about 10 to about 40 liquid volume percent of the alkylate blend component. The resulting RVP of this embodiment may also be in the range of 2 to 3 psi and the initial boiling point is from about 110 to 150 degrees Fahrenheit.

In another embodiment, an FFTF comprises no less than about 15 liquid volume percent of a heavy paraffin blend component comprising at least 55 weight percent decane, and no more than about 85 liquid volume percent of a light paraffin blend component comprising is at least about 80 weight percent octane.

In another embodiment, an FFTF comprises at least about 5 to about 30 liquid volume percent of an isopentane blend component that comprises at least 95 weight percent isopentane, at least about 35 to about 60 liquid volume percent of a heavy paraffin blend component that comprises at least 55 weight percent decane, and at least about 30 to about 45 liquid volume percent of a light paraffin blend component that comprises at least about 80 weight percent octane.

In another embodiment, an FFTF comprises at least about 40 to about 70 liquid volume percent of a heavy paraffin blend component that comprises at least 55 weight percent decane, from 0 to about 20 liquid volume percent of an isopentane blend component that comprises at least 95 weight percent isopentane, and from at least about 25 to about 45 liquid volume percent of an alkylate blend component that comprises at least about 50 weight percent octane.

Adding one or more oxygenates as a blend component of an FFTF blend further reduces emissions generated by a burn. The oxygenates add oxygen to the blend, which increases the combustibility of the blend, thereby reducing emissions. Oxygenates may be added to any FFTF composition or blend, for example the paraffin blends described herein. Generally, oxygenates are selected because their boiling points are about equal to or below the boiling points of the FFTF. Also, certain oxygenates have low water solubility, which makes putting out the fires and cleanup easier. The amount of oxygenates added corresponds to a weight percent oxygen added to the blend. In an embodiment, oxygenates comprise no less than about 5 and no more than about 50 liquid volume percent of a blend. In another embodiment, oxygenates comprise no less than about 10 and no more than about 30 liquid volume percent of a blend.

The oxygen content in a blend provided by oxygenates typically comprises no more than about 6 weight percent and no less than about 0.5 weight percent. In an embodiment, the oxygen content provided to a blend by oxygenates comprises no more than about 3.5 weight percent and no less than about 1.5 weight percent. In another embodiment, the oxygen content provided to a blend by oxygenates comprises no more than about 2.2 weight percent and no less than about 1.8 weight percent.

Oxygenates may be selected from the class of oxygenates including alcohols, ethers, carboxylic acids, epoxides, and combinations thereof where the selected oxygenates possess boiling points of no less than about 80 degrees Fahrenheit and no more than about 370 degrees Fahrenheit. In an embodiment, the oxygenates may be selected from a group consisting of methyl tertiary butyl ether (MTBE), ethyl tertiary butyl ether (ETBE), ethanol, propyl acetate, butyl acetate, 2-ethoxyethanol, and combinations thereof. In an embodiment, the oxygenates comprise ETBE and/or ethanol and are added to the paraffin blends described herein.

In an embodiment for preparing FFTFs as shown by FIG. 1, a 70,490 gallon portion of a heavy paraffin stream 10 is collected in a tank 50. A 6,148 gallon portion of a light paraffin stream 20 is also collected in the tank 50. The heavy and light paraffin streams 10, 20 are cuts from a petroleum refinery distillation column. Further, 28,302 gallons of a light alkylate stream 30 from a hydrofluoric acid alkylation unit are fed to the tank 50, and 1,060 gallons of an isopentane stream 40 from an isomerization unit are added to the tank 50. In this embodiment, the heavy paraffin stream 10 comprises at least about 55 weight percent decane, the light paraffin stream 20 comprises at least about 80 weight percent octane, the isopentane stream 40 comprises about 95 percent isopentane, and the light alkylate stream 30 comprises about 50 weight percent octane. In this embodiment, the specific quantities of each blend component result in a blend comprising 66.5 liquid volume percent heavy paraffin, 5.8 liquid volume percent light paraffin, 26.7 liquid volume percent of the light alkylate, and 0.1 liquid volume percent of the isopentane. The resultant RVP of the blend of this embodiment is between 2 and 3 psi. The boiling point range of the blend of this embodiment is from about 113 degrees Fahrenheit to about 358 degrees Fahrenheit. The blend components of this blend may be metered directly into the tank 50 because the blend components are miscible and mix immediately, i.e., no agitation is necessary to generate a homogeneous mixture. Alternatively, a mixer or roll-in, depending on the type of tank, may be used to ensure even mixing of the blend. The blend components may be metered into the tank on a mass basis, mixed or rolled until well-combined, and then sampled for certification. In an embodiment, certification is met where the blend has an RVP of less than about 6.5 and more than about 1, and has an initial boiling point of not less than about 80 degrees Fahrenheit and an end boiling point of not more than about 370 degrees Fahrenheit. The mixed blend is dispensed via stream 60 as needed for shipment to customers.

The FFTF blends of the present invention may be employed in a variety of firefighting training scenarios. The simplest is the pan burn, wherein the FFTF is poured into a pan containing water. The water serves to protect the concrete and pan from the evolved heat. The blend is ignited and such a pan burn is a common exercise for fire extinguisher training. Other training may involve the use of other props such as loading racks for railcars, flanges, pumps, airplanes, etc. In some of the scenarios, the fuel pours or squirts out of a hole in a piece of equipment. Flange fires are generally more difficult to extinguish when the burning fluid is lighter because the fire crawls up the fuel to the source of the leak. If a heavier fuel is used, a separation between the leaking fuel and the fire exists and the fire fighter need only blow the fire off the fuel stream with his or her hose. In this way, the ability of the FFTFs described herein to accurately mimic both lighter and heavier fuel fires allows them to closely duplicate reality.

The blends described herein are also environmentally friendly in that emissions of smoke, particulates, and volatile organic compounds (VOCs) are minimal, and the concentrations of sulfur, aromatic, and olefinic compounds are low. In addition, fewer hazardous wastes are created because the paraffin blends leave significantly less residue than diesel/gasoline mixtures when burned to completion. Plus, with incomplete burns, the remaining fluid may be recycled and reused. The concentration of aromatics in the blends is typically less than about 10 liquid volume percent, and in some embodiments less than about 1 liquid volume percent. Likewise, the concentration of olefins in the blends is typically less than about 10 liquid volume percent, and in some embodiments less than about 1 liquid volume percent. Similarly low is the concentration of sulfur in the blends, which is typically less than 10 parts per million by weight. When burned, the blends typically emit less than about 0.0130 pounds of volatile organic compounds per pound of fluid burned, alternatively less than about 0.010 pounds of volatile organic compounds per pound of fluid burned. In addition, burning the blends typically produces less than about 0.030 pounds of particulate matter per pound of fluid burned.

EXAMPLES

The invention having been generally described, the following examples are given as particular embodiments of the invention and to demonstrate the practice and advantages thereof. It is understood that the examples are given by way of illustration and are not intended to limit the specification or the claims to follow in any manner.

Examples 1-4

Examples 1-4 show paraffin blending components suitable for use in FFTFs, and gas chromatogram data for each blending component is listed in Tables 1-4, respectively. Example 1 is an isopentane blend component, Example 2 is a heavy paraffin blend component, Example 3 is a light paraffin blend component, and Example 4 is an alkylate blend component. Table 1 contains the weight percent of each component present in an isopentane blend component.

TABLE 1

| Example of Isopentane Blend Component | |
|---|---|
| COMPONENT | WT % |
| 2,2-Dimethylpropane | 0.3 |
| Isopentane | 98.4 |

TABLE 1-continued

| Example of Isopentane Blend Component | |
|---|---|
| COMPONENT | WT % |
| n-Pentane | 1.2 |
| Impurities | 0.2 |
| TOTAL | 100.0 |

Table 2 contains the weight percent of each compound present in a heavy paraffin blend component. "C8s" represents the weight percentage of chemical compounds in the blend component having 8 carbon atoms, "C9s" represents the weight percentage of chemical compounds in the blend component having 9 carbon atoms, and so forth.

TABLE 2

| Example of Heavy Paraffin Blend Component | |
|---|---|
| COMPONENT | WT % |
| C8s | 3 |
| C9s | 14 |
| C10s | 62 |
| C11s | 20 |
| other | 1 |
| TOTAL | 100 |

Table 3 contains the weight percent of each compound present in a light paraffin blend component.

TABLE 3

| Example of Light Paraffin Blend Component | |
|---|---|
| COMPONENT | WT % |
| C2s | 0 |
| C3s | 0.3 |
| C4s | 0.9 |
| C5s | 1.4 |
| C6s | 2.0 |
| C7s | 4.9 |
| C8s | 84.7 |
| C9s | 1.2 |
| C10s | 3.5 |
| C11s | 0.9 |
| C12s and higher | 0 |
| TOTAL | 100.0 |

The data in Table 4 gives an example of the weight percent of each compound present in an alkylate blend component.

EXAMPLE TABLE 4

| Example of Alkylate Blend Component | |
|---|---|
| COMPONENT | WT % |
| C4s | 1.5 |
| C5s | 5.7 |
| C6s | 3.9 |
| C7s | 21.0 |
| C8s | 60.6 |
| C9s | 4.0 |
| C10s | 2.8 |

EXAMPLE TABLE 4-continued

| Example of Alkylate Blend Component | |
|---|---|
| COMPONENT | WT % |
| C11s | 0.5 |
| C12s | 0.1 |
| TOTAL | 100.0 |

Example 5

Example 5 is an FFTF comprising a blend of the heavy, light, and isopentane blend components, as illustrated by Examples 2, 3, and 1, respectively. Data for Example 5 is provided in Table 5.

TABLE 5

| Example of Paraffin Blend Including Heavy, Light, and Isopentane Blend Components | | |
|---|---|---|
| ITEM | VALUE | TEST METHOD |
| Heavy LV % (gallons) | 40.8 (16,198) | |
| Light LV % (gallons) | 37.2 (14,768) | |
| Isopentane LV % (gallons) | 22 (8,734) | |
| Aromatic LV % | 0.2 | ASTM D-1319 |
| Reid Vapor Pressure | 6.0 | ASTM D-323 (psi) |
| Initial Distillation Boiling Point | 106.2 | ASTM D-86 (° F.) |
| End Distillation Boiling Point | 366.6 | ASTM D-86 (° F.) |

Example 6

Example 6 is an FFTF comprising a blend of the heavy and light paraffin blend components, as illustrated by Examples 2 and 3, respectively. Data for Example 6 is provided in Table 6.

TABLE 6

| Example of Paraffin Blend Including Heavy and Light Blend Components | | |
|---|---|---|
| ITEM | VALUE | TEST METHOD |
| Heavy LV % (gallons) | 60 (3) | |
| Light LV % (gallons) | 40 (2) | |
| Aromatic LV % | 0 | ASTM D-1319 |
| Reid Vapor Pressure | 2.4 | ASTM D-323 (psi) |
| Initial Distillation Boiling Point | 111.6 | ASTM D-86 (° F.) |
| End Distillation Boiling Point | 358.3 | ASTM D-86 (° F.) |

Example 7

Example 7 is an FFTF comprising a blend of the heavy, alkylate, and isopentane blend components, as illustrated by Examples 2, 4, and 1, respectively. Data for Example 7 is provided in Table 7.

TABLE 7

| Example of Paraffin Blend Including Heavy, Alkylate, and Isopentane Blend Components | | |
|---|---|---|
| ITEM | VALUE | TEST METHOD |
| Heavy LV % (gallons) | 59.4 (33,264) | |
| Alkylate LV % (gallons) | 30.6 (17,136) | |
| Isopentane LV % (gallons) | 10 (5,600) | |
| Aromatic LV % | 0.4 | ASTM D-1319 |
| Reid Vapor Pressure | 4.4 | ASTM D-323 (psi) |
| Initial Distillation Boiling Point | 108.7 | ASTM D-86 (° F.) |
| End Distillation Boiling Point | 358.9 | ASTM D-86 (° F.) |

Example 8

Example 8 is an FFTF comprising a blend of the heavy, light, alkylate, and isopentane blend components, as illustrated by Examples 2, 3, 4, and 1, respectively. Data for Example 8 is provided in Table 8.

TABLE 8

| Example of Paraffin Blend Including Heavy, Light, Alkylate, and Isopentane Blend Components | | |
|---|---|---|
| ITEM | VALUE | TEST METHOD |
| Heavy LV % (gallons) | 66.5 (70,490) | |
| Light LV % (gallons) | 5.8 (6,148) | |
| Alkylate LV % (gallons) | 26.7 (28,302) | |
| Isopentane LV % (gallons) | 1 (1,060) | |
| Aromatic LV % | 0.9 | ASTM D-1319 |
| Reid Vapor Pressure | 2.92 | ASTM D-323 (psi) |
| Initial Distillation Boiling Point | 113.2 | ASTM D-86 (° F.) |
| End Distillation Boiling Point | 357.6 | ASTM D-86 (° F.) |

Example 9

Example 9 is an FFTF comprising a blend of the heavy, light, and isopentane blend components corresponding to those in Examples 2, 3, and 1, respectively, and oxygenates. In this example, the oxygenate is ethyl tertiary butyl ether (ETBE). Data for Example 9 is provided in Table 9.

TABLE 9

| Example of Paraffin Blend Including Heavy and Light Paraffin Blend Components, and Oxygenates | | |
|---|---|---|
| ITEM | VALUE | TEST METHOD |
| Heavy LV % (gallons) | 50.7 (27.8) | |
| Light LV % (gallons) | 33.9 (18.6) | |
| Isopentane LV % (gallons) | 1.4 (0.8) | |
| ETBE LV % (gallons) | 13.9 (7.6) | |
| Aromatic LV % | 8.8 | ASTM D-1319 |
| Reid Vapor Pressure | 2.49 | ASTM D-323 (psi) |
| Initial Distillation Boiling Point | 145.9 | ASTM D-86 (° F.) |
| End Distillation Boiling Point | 354.3 | ASTM D-86 (° F.) |

Example 10

Example 10 lists oxygenates and the liquid volume percent of each oxygenate added to an FFTF, for example a paraffin blend as disclosed herein, in order to achieve certain weight percent oxygen levels in the blend. The data for Example 10 is provided in Table 10.

TABLE 10

Liquid Volume Percent of Oxygenate and Corresponding Blended Weight Percent Oxygen

| OXYGENATE | WT % OXYGEN | LV % OXYGENATE |
|---|---|---|
| MTBE | 1 | 5.35 |
| | 2 | 10.75 |
| | 3 | 16.10 |
| | 5 | 26.85 |
| ETBE | 1 | 6.20 |
| | 2 | 12.45 |
| | 3 | 18.70 |
| | 5 | 31.15 |
| Ethanol | 1 | 2.65 |
| | 2 | 5.31 |
| | 3 | 7.97 |
| | 5 | 13.28 |

Comparative Example 11

Comparative Example 11 provides a comparison of the combustion products of a paraffin FFTF blend as disclosed herein and an oxygenated paraffin FFTF blend as disclosed herein to those of a conventional 60:40 diesel:gasoline blend. Both volatile organic compounds (VOCs) and particulate matter (soot) were measured quantitatively. A two-fluid-ounce sample of the product under test was poured into the bottom of a flat pan and immediately ignited using a fireplace match. Data was gathered until the flame self-extinguished and no significant volume of volatile organic compound (VOC) was being emitted. For the products tested, the data collection time was approximately three minutes. Volatile organic carbon was measured with a Ratfisch RS55CA total hydrocarbon analyzer with a flame ionization detector. VOCs are reported as methane. Particulate matter was collected on glass fiber filters and the particulate mass was measured by weighing. Data is reported as pound of VOC or particulate per pound of sample fluid. Each product was evaluated in three replicate test runs and the results in Table 11 represent the average of those three runs. As expected, the paraffin blends of the present invention emitted less particulate matter and fewer VOCs than did the conventional 60:40 diesel/gasoline blend. The high burn temperature of the paraffin blends resulted in greater combustion to $CO_2$ and contributed to particulate matter that dissipates readily. Data for Example 11 is provided in Table 11.

Figure 2:
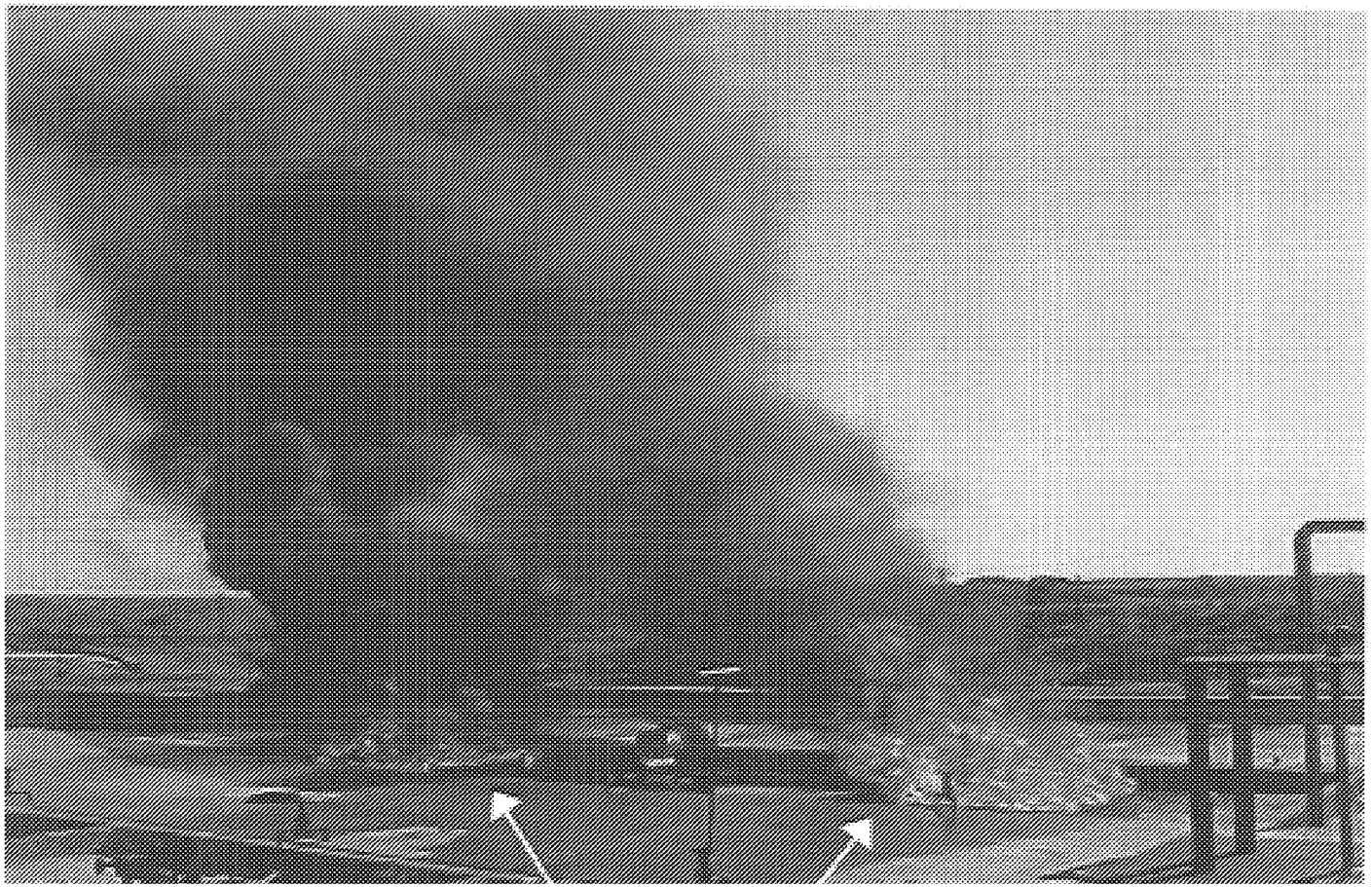
FIG. 2 is a first photograph of a side-by-side comparison of the visible emissions given off by the burning of an FFTF that is a gasoline/diesel blend, and an FFTF, excluding oxygenates, in accordance with the present invention.
Figure 3:
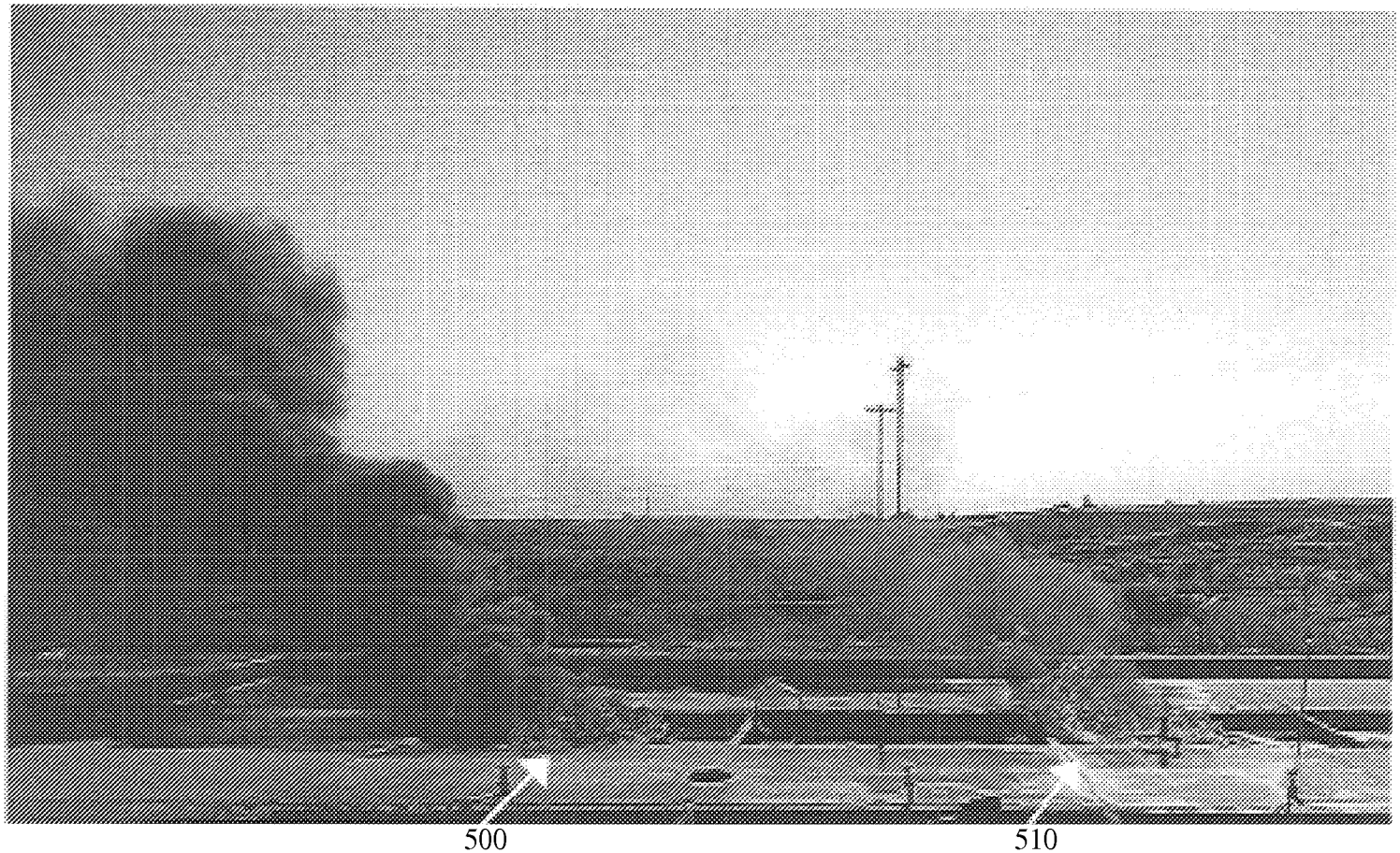
FIG. 3 is a second photograph of a side-by-side comparison of the visible emissions given off by the burning of an FFTF that is a gasoline/diesel blend, and an FFTF, excluding oxygenates, in accordance with the present invention.
Figure 4:
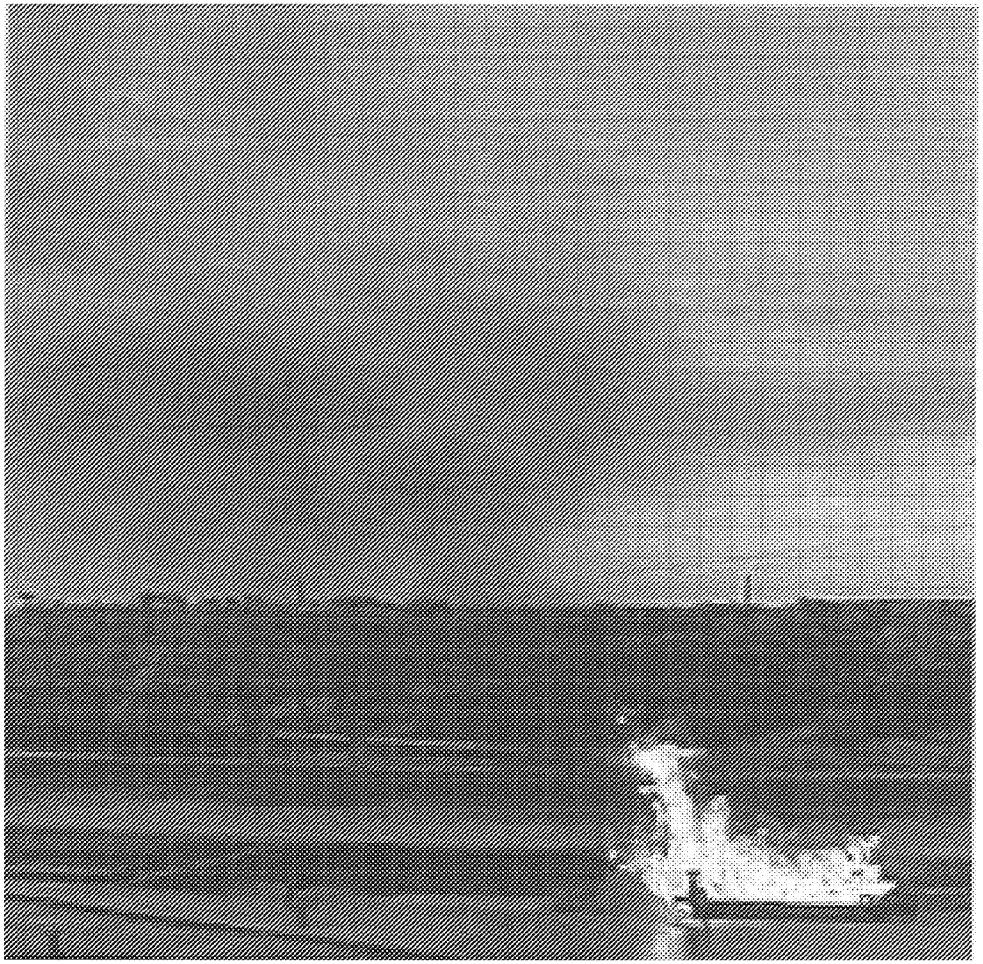
FIG. 4 is a photograph of the emissions given off by the burning of an FFTF, including 14.5 liquid volume percent oxygenates, in accordance with the present invention.
Figure 5:
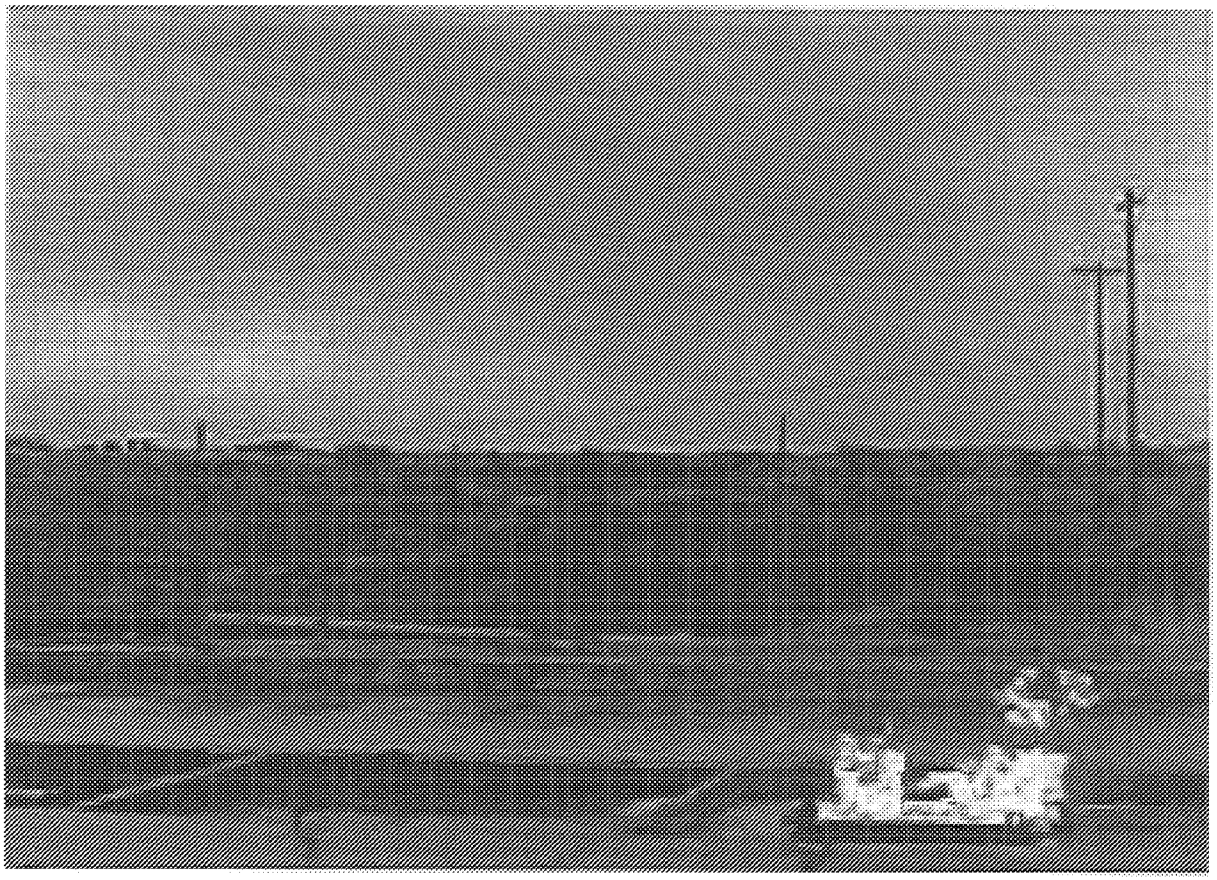
FIG. 5 is a photograph of the emissions given off by the burning of an FFTF, including 25 liquid volume percent oxygenates, in accordance with the present invention.
Figure 6:
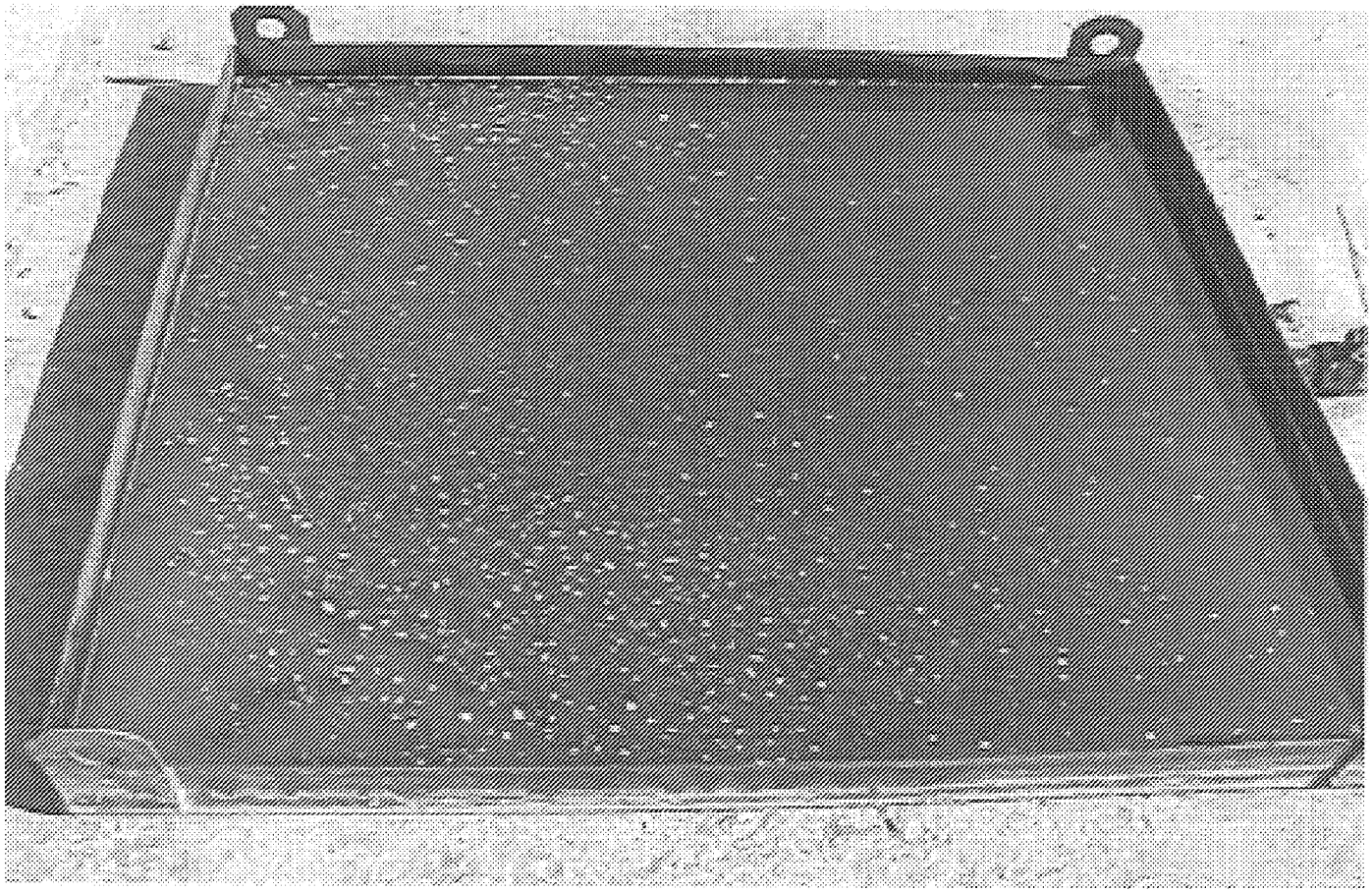
FIG. 6 is a photograph of pan residue following a pan burn of an FFTF comprising 60:40 diesel/gasoline blend.
Figure 7:
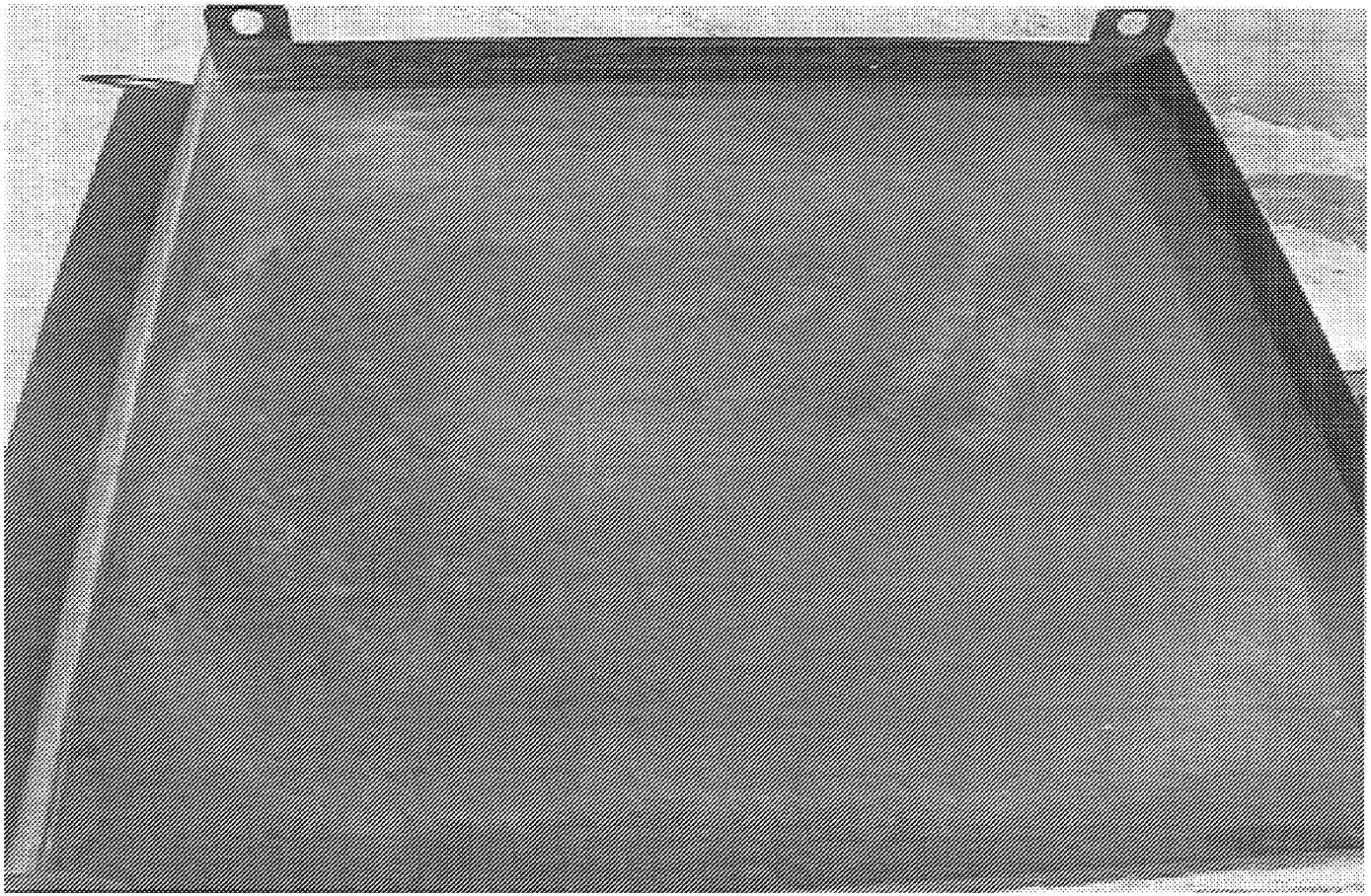
FIG. 7 is a photograph of pan residue following a pan burn of an FFTF comprising a paraffin blend without oxygenates.
Figure 8:
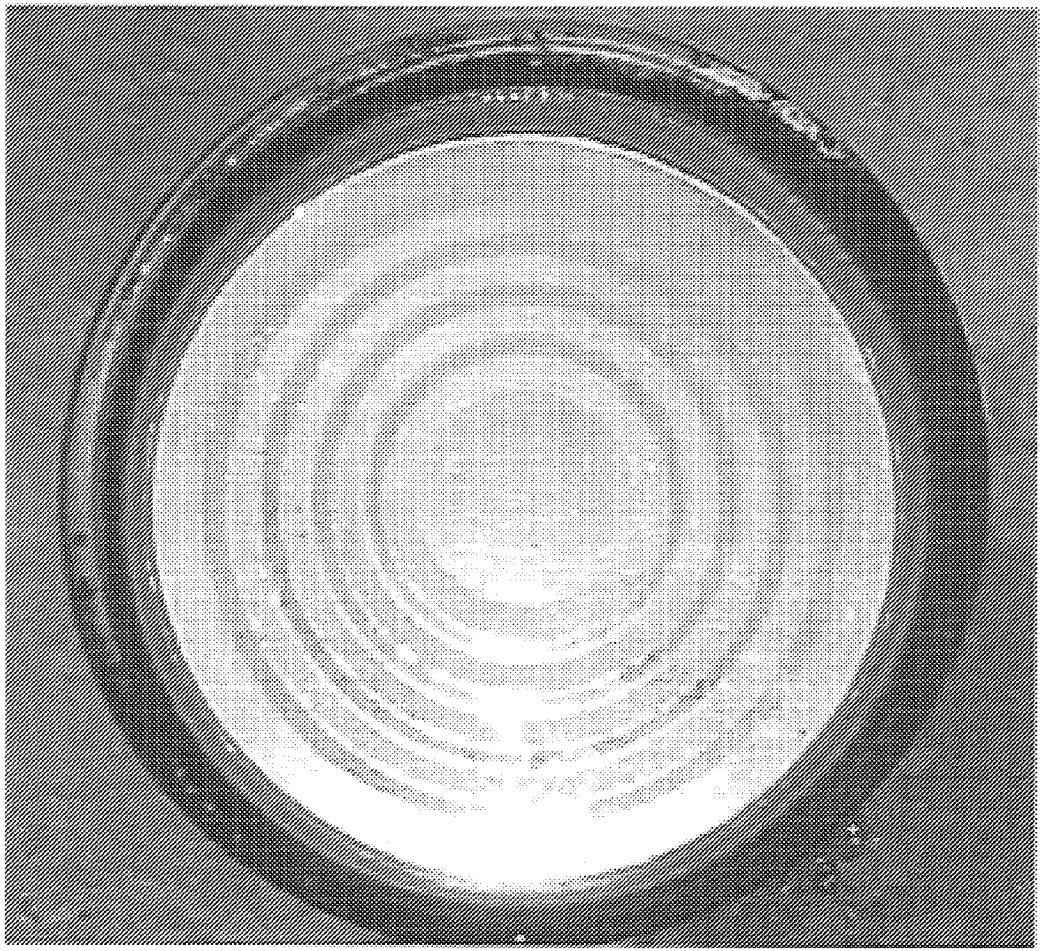
FIG. 8 is a photograph of pan residue following a pan burn of an FFTF comprising a paraffin blend with 25 liquid volume percent oxygenates.

FIGS. 2 through 5 are photographs that comparatively demonstrate the differences in emissions given off when burning an FFTF made up of a gasoline/diesel blend, and an FFTF in accordance with the present invention. FIG. 2 is a first photograph in which a gasoline/diesel blend 500 is burned next to a non-oxygenated FFTF 510 in accordance with the present invention. FIG. 3 is a second photograph in which a gasoline/diesel blend 500 is burned next to a non-oxygenated FFTF 510 in accordance with the present invention. In both FIGS. 2 and 3, significantly fewer emissions are visible from the burn of the FFTF blend 510, than can be seen emitting from the burn of the gasoline/diesel blend 500. FIG. 4 is a photograph in which an FFTF that is a paraffin blend, including 14.5 liquid volume percent (LV %) oxygenates, is burned. FIG. 5 is a photograph in which an FFTF that is a paraffin blend, including 25 liquid volume percent oxygenates, is burned. Comparing FIGS. 4 and 5 shows the relative reduction in emissions that occurs from a burn by increasing the amount of oxygenates from 14.5 LV % to 25 LV %. In addition, comparing FIGS. 4 and 5 to FIGS. 1 and 2 shows significantly fewer emissions visible from the burn of the oxygenated FFTF blends as compared to the burn of the gasoline/diesel blend 500. FIGS. 6, 7, and 8 are photographs of the pan residue remaining following a pan burn of a 60:40 diesel/gasoline blend, a paraffin FFTF blend without oxygenates, and a paraffin FFTF blend with oxygenates, respectively. As can be seen by comparison of FIGS. 6, 7, and 8, the paraffin blend either with or without oxygenates burns completely and leaves significantly less residue post-burn.

TABLE 11

Example of VOC and Particulate Data

| CHARACTERISTIC | 60:40 DIESEL/ GASOLINE | PARAFFIN BLEND WITHOUT OXYGENATES | PARAFFIN BLEND WITH OXYGENATES |
|---|---|---|---|
| Particulate | 0.0356 | 0.0220 | 0.0148 |
| VOCs | 0.0197 | 0.0099 | 0.0099 |

While embodiments of the invention have been shown and described, modifications thereof can be made by one skilled in the art without departing from the spirit and teachings of the invention. The embodiments described herein are exemplary only, and are not intended to be limiting. Equivalent techniques and ingredients may be substituted for those shown, and other changes can be made within the scope of the present invention as defined by the appended claims. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

We claim:

1. A firefighter training method comprising:

(a) providing a training fluid consisting of a blend of:

(i) a first paraffin blend component consisting of at least about 55 weight percent decane with the remainder consisting of other alkanes; and (ii) a second paraffin blend component consisting of at least about 80 weight percent octane with the remainder consisting of other alkanes; and (iii) optionally one or more oxygenates, wherein the oxygenates are selected from the group consisting of alcohols, ethers, carboxylic acids, epoxides, and combinations thereof;

(b) igniting the training fluid to provide a firefighter training scenario; and (c) extinguishing the training fluid by one or more firefighter trainees.

2. The method of claim 1 wherein the training fluid consists essentially of no less than about 15 liquid volume percent of the first paraffin blend component and no more than about 85 liquid volume percent of the second paraffin blend component.

3. The method of claim 1 wherein the training fluid consists essentially of no more than about 60 liquid volume percent of the first paraffin blend component and no less than about 40 liquid volume percent of the second paraffin blend component.

4. The method of claim 1 wherein the first paraffin blend component and the second paraffin blend component are cuts from a petroleum refinery distillation column.

5. The method of claim 1 wherein the training fluid has no more than about 10 liquid volume percent aromatics.

6. The method of claim 1 wherein the training fluid has no more than about 10 liquid volume percent olefins.

7. A firefighter training method comprising:

(a) providing a training fluid consisting of a blend of:

(i) a first paraffin blend component consisting of at least about 55 weight percent decane with the remainder consisting of other alkanes;

(ii) a second paraffin blend component consisting of at least about 80 weight percent octane with the remainder consisting of other alkanes;

(iii) an isopentane blend component comprising at least about 95 weight percent isopentane with the remainder consisting of other alkanes; and (iv) optionally one or more oxygenates, wherein the oxygenates are selected from the group consisting of alcohols, ethers, carboxylic acids, epoxides, and combinations thereof;

(b) igniting the training fluid to provide a firefighter training scenario; and (c) extinguishing the training fluid by one or more firefighter trainees.

8. The method of claim 7 wherein the training fluid consists essentially of:

from about 5 to about 30 liquid volume percent of the isopentane blend component;

from about 35 to about 60 liquid volume percent of the first paraffin blend component; and from about 30 to about 45 liquid volume percent of the second paraffin blend component.

9. The method of claim 7 wherein the first paraffin blend component and the second paraffin blend component are cuts from a petroleum refinery distillation column and the isopentane blend component is from an isomerization unit.

10. The method of claim 7 wherein the training fluid has no more than about 10 liquid volume percent aromatics.

11. The method of claim 7 wherein the training fluid has no more than about 10 liquid volume percent olefins.

12. A firefighter training method comprising:

(a) providing a training fluid consisting of a blend of:

(i) a first paraffin blend component consisting of at least about 55 weight percent decane with the remainder consisting of other alkanes;

(ii) an isopentane blend component consisting of at least about 95 weight percent isopentane with the remainder consisting of other alkanes;

(iii) an alkylate blend component consisting of at least about 50 weight percent octane with the remainder consisting of other alkanes; and (iv) optionally one or more oxygenates, wherein the oxygenates are selected from the group consisting of alcohols, ethers, carboxylic acids, epoxides, and combinations thereof;

(b) igniting the training fluid to provide a firefighter training scenario; and (c) extinguishing the training fluid by one or more firefighter trainees.

13. The method of claim 12 wherein the training fluid consists essentially of:

from about 40 to about 70 liquid volume percent of the first paraffin blend component;

from greater than 0 to about 20 liquid volume percent of the isopentane blend component; and from about 25 to about 45 liquid volume percent of the alkylate blend component.

14. The method of claim 12 wherein the first paraffin blend component is a cut from a petroleum refinery distillation column; the isopentane blend component is from an isomerization unit; and the alkylate blend component is from a hydrofluoric acid alkylation unit.

15. The method of claim 12 wherein the training fluid has no more than about 10 liquid volume percent aromatics.

16. The method of claim 12 wherein the training fluid has no more than about 10 liquid volume percent olefins.

17. A firefighter training method comprising:

(a) providing a training fluid consisting of a blend of:

(i) a first paraffin blend component consisting of at least about 55 weight percent decane with the remainder consisting of other alkanes;

(ii) a second paraffin blend component consisting of at least about 80 weight percent octane with the remainder consisting of other alkanes;

(iii) an isopentane blend component consisting of at least about 95 weight percent isopentane with the remainder consisting of other alkanes;

(iv) an alkylate blend component consisting of at least about 50 weight percent octane with the remainder consisting of other alkanes; and (v) optionally one or more oxygenates, wherein the oxygenates are selected from the group consisting of alcohols, ethers, carboxylic acids, epoxides, and combinations thereof;

(b) igniting the training fluid to provide a firefighter training scenario; and (c) extinguishing the training fluid by one or more firefighter trainees.

18. The method of claim 17 wherein the training fluid consists essentially of:

from about 50 to about 80 liquid volume percent of the first paraffin blend component;

from greater than 0 to about 10 liquid volume percent of the second paraffin blend component;

from about 1 to about 5 liquid volume percent of the isopentane blend component; and from about 10 to about 40 liquid volume percent of the alkylate blend component.

19. The method of claim 17 wherein the first paraffin blend component and the second paraffin blend component are cuts from a petroleum refinery distillation column; the isopentane blend component is from an isomerization unit; and the alkylate blend component is from a hydrofluoric acid alkylation unit.

20. The method of claim 17 wherein the training fluid has no more than about 10 liquid volume percent aromatics.

21. The method of claim 17 wherein the training fluid has no more than about 10 liquid volume percent olefins.

22. The method of claim 1 wherein ignition produces less than about 0.0130 pounds of volatile organic compounds per pound of the training fluid.

23. The method of claim 1 wherein ignition produces less than about 0.010 pounds of volatile organic compounds per pound of the training fluid.

24. The method of claim 1 wherein ignition produces less than about 0.030 pounds of particulate matter per pound of the training fluid.

25. The method of claim 1 wherein the oxygenates are selected from the group consisting of methyl tertiary butyl ether (MTBE), ethyl tertiary butyl ether (ETBE), ethanol, propyl acetate, butyl acetate, 2-ethoxyethanol, and combinations thereof.

26. The method of claim 7 wherein the oxygenates are selected from the group consisting of methyl tertiary butyl ether (MTBE), ethyl tertiary butyl ether (ETBE), ethanol, propyl acetate, butyl acetate, 2-ethoxyethanol, and combinations thereof.

27. The method of claim 12 wherein the oxygenates are selected from the group consisting of methyl tertiary butyl ether (MTBE), ethyl tertiary butyl ether (ETBE), ethanol, propyl acetate, butyl acetate, 2-ethoxyethanol, and combinations thereof.

28. The method of claim 17 wherein the oxygenates are selected from the group consisting of methyl tertiary butyl ether (MTBE), ethyl tertiary butyl ether (ETBE), ethanol, propyl acetate, butyl acetate, 2-ethoxyethanol, and combinations thereof.

* * * * *